US005659150A

United States Patent [19]

Butt et al.

[11] Patent Number: 5,659,150

[45] Date of Patent: Aug. 19, 1997

[54] GAS GENERATING COMPOSITION WITH CYANAMIDE AND TRANSITION METAL NITRATE

[75] Inventors: Ron J. Butt, Castle Rock; Robert N. Renz, Jr., Denver, both of Colo.

[73] Assignee: TRW Inc., Lyndhurst, Ohio

[21] Appl. No.: 633,422

[22] Filed: Apr. 17, 1996

[51] Int. Cl.[6] ..... C06D 5/06; C06B 31/28

[52] U.S. Cl. ..... 102/289; 102/290; 149/45; 149/109.2; 149/109.4

[58] Field of Search ..... 149/45, 109.2, 149/109.4; 102/288, 289, 290

[56] References Cited

U.S. PATENT DOCUMENTS

| | | | |
|---|---|---|---|
| 792,511 | 6/1905 | Frank | 149/45 X |
| 4,078,954 | 3/1978 | Bernardy | 149/19.8 |
| 5,160,386 | 11/1992 | Lund et al. | 149/88 |
| 5,197,758 | 3/1993 | Lund et al. | 280/741 |
| 5,254,324 | 10/1993 | Bottaro et al. | 423/263 |
| 5,324,075 | 6/1994 | Sampson | 280/736 |
| 5,451,682 | 9/1995 | Highsmith et al. | 548/251 |
| 5,544,687 | 8/1996 | Barnes et al. | 149/83 |
| 5,557,062 | 9/1996 | MacLaren et al. | 149/46 |

FOREIGN PATENT DOCUMENTS 9519944 7/1995 WIPO .

*Primary Examiner*—Peter A. Nelson

*Attorney, Agent, or Firm*—Tarolli, Sundheim, Covell, Tummino & Szabo

[57] ABSTRACT

The present invention comprises a gas generating composition for, when ignited, providing inflation fluid for inflating an air bag (16) of a vehicle occupant protection device (12). The composition comprises a cyanamide compound complexed with a transition metal nitrate, and a supplemental oxidizing salt admixed with the complex. A preferred cyanamide is dicyandiamide. A preferred complex is bis (dicyandiamide)copper(I)nitrate.

20 Claims, 2 Drawing Sheets

GAS GENERATING COMPOSITION WITH CYANAMIDE AND TRANSITION METAL NITRATE

FIELD OF THE INVENTION

The present invention relates to a gas generating composition which comprises an organic fuel complexed with an oxidizing salt. The present invention is particularly useful for rapidly inflating a vehicle occupant protection device.

BACKGROUND OF THE INVENTION

An inflator for inflating a vehicle occupant protection device, such as an air bag, contains a source of inflation fluid for inflating the air bag. In a particular type of inflator, the source of inflation fluid comprises a body of ignitable gas generating material. That type of inflator further includes an ignitor. The ignitor is actuated so as to ignite the body of gas generating material when the vehicle experiences a condition, such as sudden deceleration, which is indicative of a collision and when that condition is above a predetermined level that indicates a collision for which inflation of the air bag is desired. As the gas generating material burns, it generates a volume of inflation gas. The inflation gas is directed into the vehicle air bag to inflate the air bag. When the air bag is inflated, it extends into the vehicle occupant compartment and helps to protect the vehicle occupant.

It is desirable to provide a gas generating material which includes, among other features, stable and relatively inexpensive components, a short ignition period, a burn rate which is rapid but without explosive effects, and a high bulk density so that only a small amount of the gas generating material is required to produce a large amount of nontoxic and non-noxious gases.

SUMMARY OF THE INVENTION

The present invention comprises a gas generating composition for inflating a vehicle occupant protection device. The composition comprises a complex of a cyanamide compound and a transition metal nitrate. The composition further comprises a supplemental oxidizing salt admixed with the complex. A preferred cyanamide compound is dicyandiamide. A preferred transition metal nitrate is copper nitrate.

The amount of supplemental oxidizing salt preferably is that amount which results in complete combustion of the cyanamide compound and the production of a combustion product which consists essentially of nitrogen, water, carbon dioxide, carbonate and transition metal.

A preferred gas generating composition comprises about 40 to 50 weight percent bis(dicyandiamide)copper(I)nitrate admixed with about 60 to 50 weight percent oxidizing salt based on the weight of the entire composition.

The present invention also resides in an inflator for a vehicle occupant protection device comprising the above gas generating composition.

An advantage of the present invention is that the cyanamide compound is capable of complexing with a large amount of the transition metal nitrate. This means that a large amount of the oxygen required for combustion of the cyanamide compound is in intimate combination with the cyanamide compound. This provides improved burn characteristics for the cyanamide compound compared to a composition in which all of the oxygen atoms are incorporated into the composition by simple mixing of an oxidizing salt with the cyanamide compound.

BRIEF DESCRIPTION OF THE DRAWINGS

The present invention and advantages thereof will become more apparent from the following description with reference to the accompanying drawings, in which.

DETAILED DESCRIPTION OF THE PRESENT INVENTION

In the present application, all percentages are weight percentages based on the weight of the gas generating composition unless otherwise stated. However, the gas generating composition weight, for purposes of the present application, means the combination of reactive components only, and does not include the weight of inert components which do not enter into the combustion reaction. Examples of inert components may be inert compaction aids and strengthening fibers.

The gas generating composition of the present invention is for inflating a vehicle occupant protection device, such as an air bag which is inflatable to help protect a vehicle occupant in the event of a collision for which air bag inflation is desired.

Figure 1:
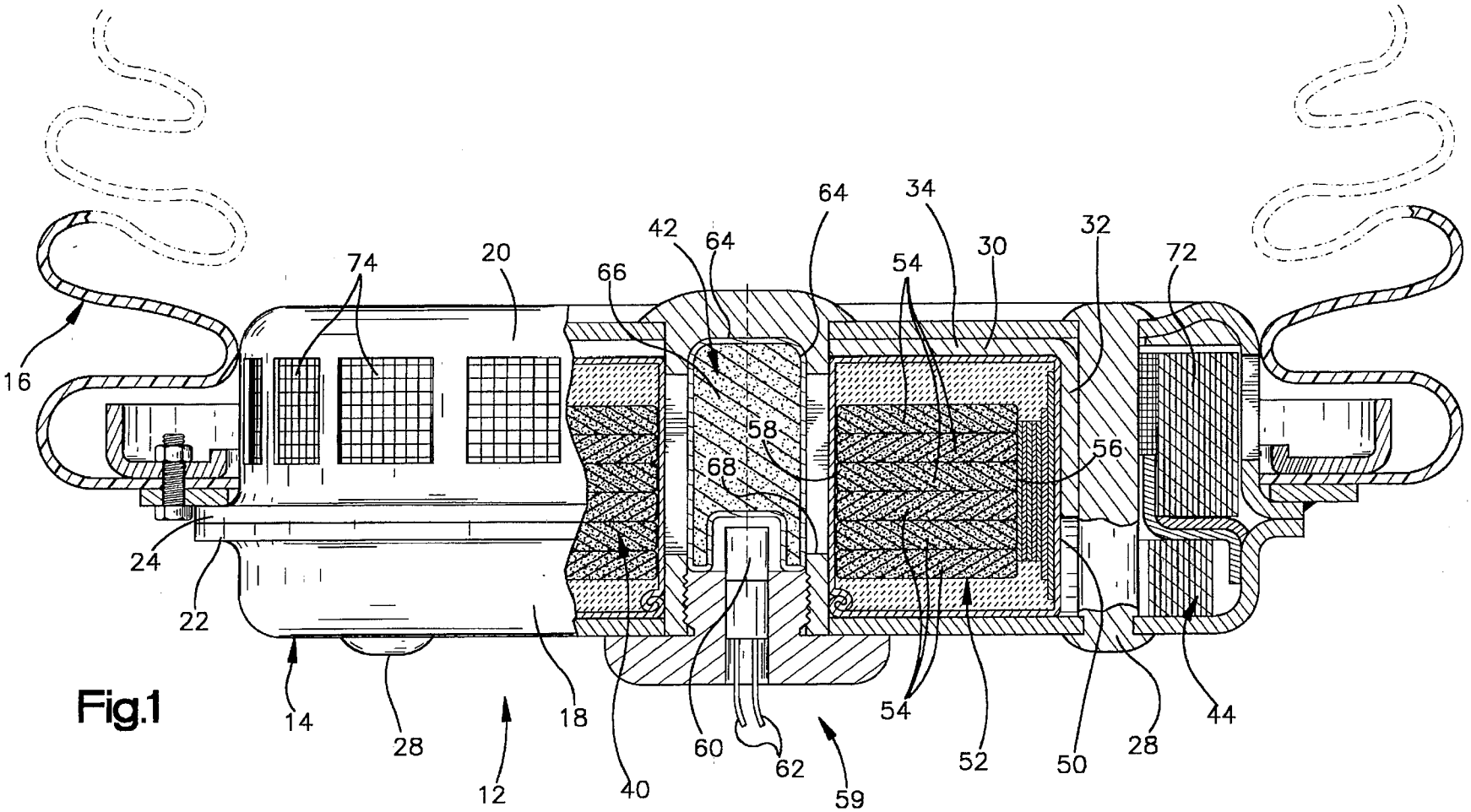
FIG. 1 is a partial section view of an inflator for providing inflation fluid for inflating a vehicle occupant protection device using a gas generating composition in accordance with the present invention.

Referring to FIG. 1, a vehicle occupant protection device 12 comprises an inflator 14 and an air bag 16. The air bag 16 is adapted to be inflated between an occupant of a vehicle and an interior portion of the vehicle. The occupant protection device 12 can be installed, by way of example, in the steering wheel (not shown) of the vehicle.

The inflator 14 comprises a base section 18 and a diffuser section 20. The two sections 18 and 20 are joined together at mounting flanges 22, 24 which are attached by means of a continuous weld. A plurality of rivets 28 also hold the diffuser section 20 and the base section 18 together.

A combustion cup 30 is seated between the diffuser section 20 and the base section 18. The combustion cup 30 comprises an outer cylindrical wall 32 and an annular top wall 34. The combustion cup 30 divides the inflator 14 into a combustion chamber 40, which is located within the combustion cup, and a filtration chamber 44, which is annular in shape and is located outside the combustion cup.

The combustion chamber 40 receives an inner container 50 which is hermetically sealed. The inner container 50 holds gas generating material 52 which is in the form of a plurality of gas generating disks 54.

The gas generating disks 54 have a generally toroidal configuration with a cylindrical exterior surface 56 and an axially extending hole defined by a cylindrical interior surface 58. The disks 54 are positioned in the container 50 in a stacked relationship with the axially extending holes in alignment. The cylindrical interior surfaces 58 encircle an ignition chamber 42. Each disk 54 has generally flat opposed surfaces and may have protuberances on such surfaces to space one disk slightly from another. This configuration of the disks 54 promotes a uniform combustion of the disks 54. Other configurations of the gas generating material 52 can also be used.

The ignition chamber 42 is defined by a two-piece, tubular ignitor housing 59 that fits within the combustion cup 40 and the disks 54 and contains a squib 60. The squib 60 contains a small charge of an ignitable material (not shown). Electric leads 62 convey a current to the squib 60. The current is provided when a sensor (not shown), which is responsive to a condition indicative of a vehicle collision, senses that the condition is above a predetermined level and closes an electrical circuit that includes a power source (not shown). The current generates heat in the squib 60 which ignites the ignitable material. The ignition chamber 42 also has a canister 64 which contains a rapidly combustible pyrotechnic material 66 such as boron potassium nitrate. The rapidly combustible pyrotechnic material 66 is ignited by the small charge of ignitable material of the squib 60. The burning pyrotechnic material 66 exits from the ignition chamber 42 through openings 68 in the ignitor housing which lead to the combustion chamber 40. The burning pyrotechnic material 66 penetrates container 50 and ignites the gas generating disks 54. Other ignition systems capable of igniting the disks 54 are well known and can be used with the present invention.

The disks 54 are made by blending together components of a gas generating composition, and then pressing the blended components into the desired configuration. Preferably, the disks 54 are made using a dry process, in which the components of the gas generating composition are dry blended together, and then compacted into the desired configuration, while still in a dry state. Alternatively, the disks 54 can be blended and formed using a wet process. In this process, the components are mixed with a liquid medium such as water or ethanol to form a slurry. The slurry may be partially dried, and then formed into the desired configuration using a press or compactor having such configuration. The formed disks 54 are then dried.

The vehicle occupant protection device 12 also comprises a filter assembly 72 in the filtration chamber 44. The filter assembly 72 is in the flow path between the combustion chamber 40 and the air bag 16. The filter assembly 72 functions to remove solid products of combustion from the combustion gases and prevent their entry into the air bag 16. The filter assembly 72 also cools the products of combustion of the disks 54.

The combustion gases from the filter assembly 72 flow through ports 74 in the side wall of the diffuser section 20 into the air bag 16 to inflate the air bag.

The gas generating composition of which the disks 54 are made comprises a complex of a cyanamide compound with an oxidizing salt comprising a transition metal nitrate. The gas generating composition also comprises a supplemental oxidizing salt providing oxygen for complete combustion of the cyanamide compound when the gas generating composition is ignited.

Examples of cyanamide compounds which are useful in the present invention are: dicyandiamide ($C_2H_4N_4$); melamine ($C_3N_3(NH_2)_3$); cyanamide salts such as calcium cyanamide (CaNCN) and zinc cyanamide (ZnNCN); hydrogen cyanamide salts such as calcium hydrogen cyanamide ($Ca(HNCN)_2$) and sodium hydrogen cyanamide ($NaHCN_2$); and mixtures of the foregoing compounds. These cyanamide fuels can be characterized as moderately energetic.

The cyanamide compounds are preferred in the gas generating composition because they are non-toxic, non-corrosive, chemically stable, and insensitive to shock and friction. The cyanamide compounds are also currently manufactured in large production quantities and are readily available at low cost. Also, the gaseous products of combustion of the cyanamide compounds are nonhazardous, and high gas yields are obtained. A particularly preferred cyanamide compound is dicyandiamide.

The transition metal nitrates readily complex with a cyanamide compound, thereby forming an intimate mixture of the cyanamide compound with the nitrate. The cyanamide compound functions as a ligand. An intimate mixture of a ligand and the nitrate is desirable to achieve improved combustion characteristics.

Transition metal nitrates are characteristically deliquescent (i.e., having a tendency to absorb atmospheric water vapor and become liquid). Because of their deliquescent nature, transition metal nitrates have not generally been considered suitable as oxidizers in propellant formulations. However, transition metal nitrates, when complexed with a ligand, are no longer deliquescent and are excellent oxidizers.

A preferred transition metal nitrate is copper nitrate. Examples of other transition metal nitrates which can be used are: manganese nitrate, iron nitrate, zinc nitrate, and zirconium nitrate.

Copper nitrate is commercially available in hydrate form, in which water molecules are complexed with the copper nitrate. The complex of copper nitrate with dicyandiamide is made by first dissolving the copper nitrate in water in the presence of a reducing agent such as sodium bisulfite ($NaHSO_3$). The sodium bisulfate gives up an electron reducing the copper(II) ion to a copper(I) ion. The dicyandiamide is added to the solution. The dicyandiamide functions as a ligand, displacing the water molecules complexed with the copper nitrate. It is believed that the ligand and copper form a six-membered ring in accordance with the following reaction:

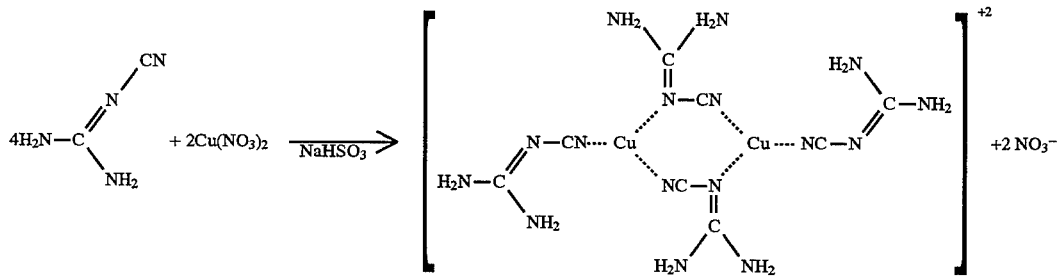

Bis(dicyandiamide)copper(I)nitrate

In the above dicyandiamidecopper(I)nitrate complex, each copper(I) ion shares electrons with two cyano (—CN) groups of two molecules of the dicyandiamide. Each copper (I) ion also shares electrons with a nitrogen atom of one of the dicyandiamide molecules to complete the six-membered ring. The solubility of the neutral complex salt (dicyandiamidecopper(1)nitrate) is relatively low, and the complex salt precipitates from solution and is recovered.

The above reaction shows a principal advantage of the present invention, namely the ability of the dicyandiamide to complex with a substantial amount of the copper nitrate. This results in an intimate combination of a large amount of oxygen with the dicyandiamide in the complex.

The supplemental oxidizing salt in the gas generating composition can be any oxidizing salt conventionally used for combustion of an organic fuel. A preferred salt is an alkali metal nitrate, preferably potassium nitrate. These nitrates are non-deliquescent and, upon combustion with a cyanamide compound, produce products of combustion which are non-toxic. Other alkali metals such as sodium and strontium can be used.

In the present invention, the transition metal nitrate is the principal source of oxygen for combustion of the cyanamide compound. The supplemental oxidizing salt is present in an amount effective to provide the supplemental oxygen required to result in complete combustion of the cyanamide compound and to produce a combustion product consisting essentially of nitrogen, water, carbon dioxide, potassium carbonate and copper.

Thus, the transition metal nitrate and supplemental oxidizing salt are present in an amount which together is approximately stoichiometric with respect to the cyanamide compound. If the gas generating composition is fuel rich, i.e., having more fuel than that necessary to react with the available oxygen, or fuel lean, i.e., having less fuel than necessary to react with the available oxygen, other products of combustion may result.

Preferably, the cyanamide compound/transition metal nitrate complex is present in the gas generating composition of the present invention in an amount in the range of about 40% to about 50% based on the weight of the gas generating composition, excluding inert components. The supplemental oxidizing salt preferably is present in the gas generating composition of the present invention in an amount of about 60% to about 50% based on the weight of the gas generating composition, excluding inert components.

The following example serves to illustrate the present invention further.

EXAMPLE

A gas generating composition of the present invention was prepared. The composition (100 grams) comprised a mixture of bis(dicyandiamide)copper(I)nitrate complex and potassium nitrate, in the following proportions.

| Ingredient | Weight grams |
|---|---|
| bis(dicyandiamide)-copper(I)nitrate complex | 44.6 |
| potassium nitrate | 55.4 |

The complex, having the empirical formula $Cu_2(C_2H_4N_4)_4(NO_3)_2$, comprised 25.52 grams of dicyandiamide and 19.08 grams of copper nitrate. The density of the gas generating composition was determined to be 1.96 grams/cubic centimeter.

The gas generating composition was burned in a closed test chamber. The following test results were obtained:

TABLE 1

| | |
|---|---|
| Burn rate | 0.05–0.07 inches/sec. |
| Average Pressure | 3246 psi |
| Burn Time | 879 ms |
| Peak Pressure | 4468 psi |
| At Time | 168 ms |
| Combustion Chamber Temperature | 3235° F. (2052° K.) |

By computer modeling, it was determined that the following products of combustion were obtained:

TABLE 2

| Products of Combustion | Mols of Product |
|---|---|
| $N_2$ | 0.96 |
| $H_2O$ | 0.56 |
| $CO_2$ | 0.38 |
| $K_2CO_3$ | 0.22 |
| Cu | 0.15 |

Other oxides and solids were produced but only in trace amounts.

Table 2 shows that with 55.4 weight percent potassium nitrate, sufficient oxygen was available to convert whatever carbon monoxide was formed to carbon dioxide, and whatever hydrogen is formed to water.

The products of combustion, when exhausted to atmosphere, simulating inflation of an air bag, had a temperature of 1296° K. (1874° F.).

An advantage of the present invention is that a substantial proportion of the oxygen atoms required to achieve complete combustion, that is oxidation of whatever carbon monoxide is formed into carbon dioxide, and whatever hydrogen is formed into water, is in the complex with the dicyandiamide. This provides a more efficient burn mixture than one in which the reaction mixture is prepared by simple mixing.

An example of a simple burn mixture is given in prior U.S. Pat. No. 792,511. In this patent, 85 to 95 percent of an oxidizing salt, based on the total composition weight, is mixed with dicyandiamide. In the present invention, the amount of oxidizing salt, e.g., potassium nitrate, added by simple admixture to the reaction mixture, is only 55.4 weight percent.

Figure 2:
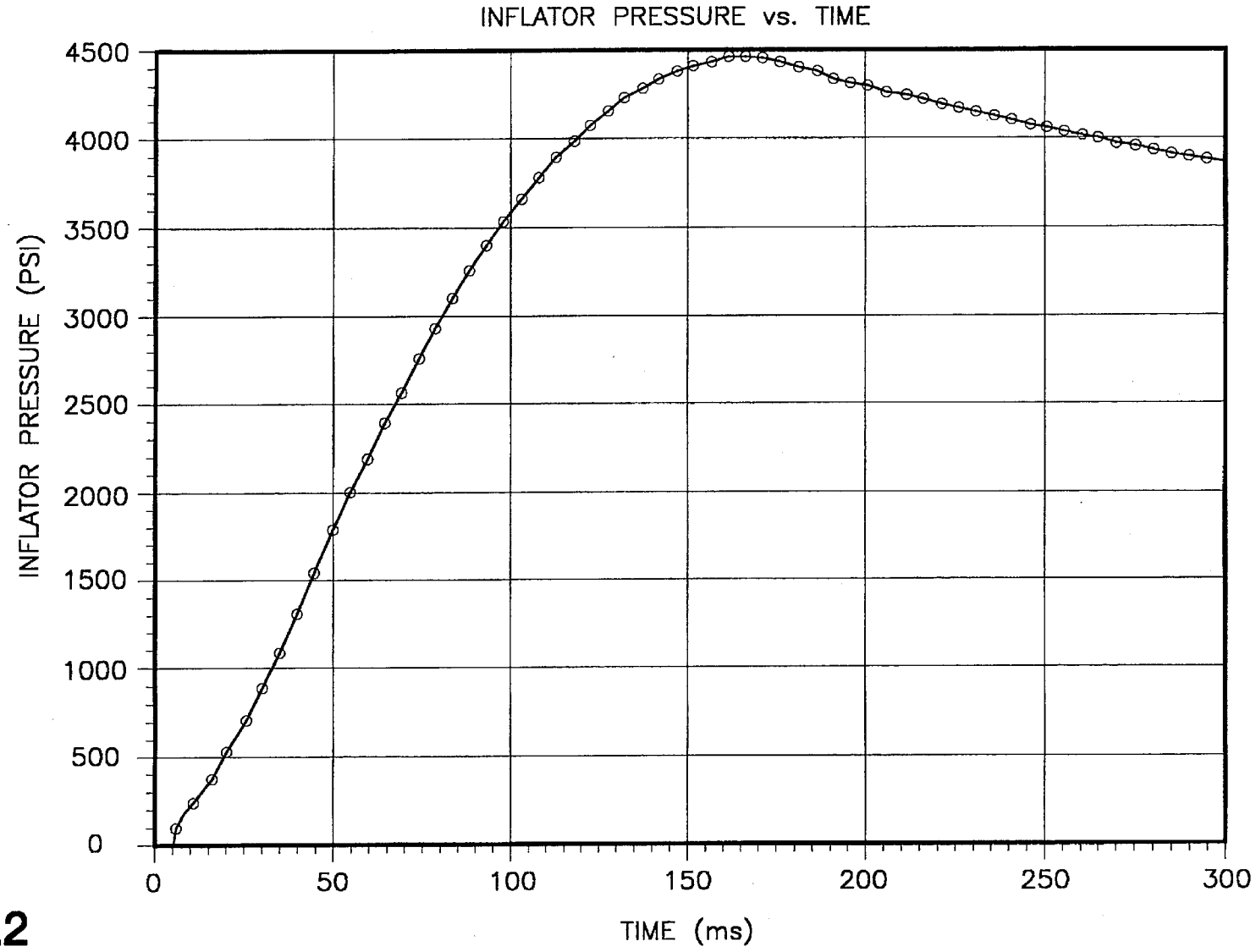
FIG. 2 is a computer generated graph showing the rate of increase in inflator pressure resulting from combustion of the gas generating composition of the inflator of FIG. 1.

The effectiveness of the complex of the present invention is illustrated in FIG. 2. Referring to FIG. 2, it can be seen that the composition achieved a maximum pressure in about 170 milliseconds. A first pressure reading was obtained in about 1.9 milliseconds. The slope in the first 100 milliseconds had an average pressure increase of about 35 psi per millisecond, which is indicative of a good burn rate.

The curve of FIG. 2 can of course be varied by the use of different oxidants and adjustment of such variables as particle size and disk configuration.

From the above description of the invention, those skilled in the art will perceive improvements, changes and modifications. Such improvements, changes and modifications within the skill of the art are intended to be covered by the appended claims.

Having described the invention, the following is claimed:

1. A gas generating composition for inflating a vehicle occupant protection device comprising:

(a) a complex of a cyanamide compound and a transition metal nitrate; and (b) a supplemental oxidizing salt admixed with said complex.

2. The composition of claim 1 wherein said supplemental oxidizing salt is present in an amount effective to result in complete combustion of said cyanamide and to produce a combustion product consisting essentially of nitrogen, water, carbon dioxide, carbonate and transition metal.

3. The composition of claim 1 wherein said cyanamide is dicyandiamide.

4. The composition of claim 3 wherein said transition metal nitrate is copper nitrate.

5. The composition of claim 4 wherein said complex is bis(dicyandiamide)copper(I)nitrate.

6. The composition of claim 1 comprising on a weight basis about 40 to about 50% complex and about 60 to about 50% supplemental oxidizing salt.

7. A gas generating composition for inflating a vehicle occupant protection device comprising a ligand and an oxidizing salt wherein said ligand is a cyanamide and at least a part of said oxidizing salt is a transition metal nitrate complexed with said cyanamide.

8. The composition of claim 7 wherein the complex of said cyanamide and said transition metal nitrate is fuel rich and said composition comprises a supplemental oxidizing salt, the amount of said supplemental oxidizing salt being effective to result in complete combustion of said cyanamide and to produce a combustion product consisting essentially of nitrogen, water, carbon dioxide, carbonate and transition metal.

9. The composition of claim 8 wherein said cyanamide is dicyandiamide.

10. The composition of claim 9 wherein said transition metal nitrate is copper nitrate.

11. The composition of claim 10 wherein the complex is bis(dicyandiamide)copper(I)nitrate.

12. The composition of claim 7 comprising on a weight basis about 40 to about 50% complex and about 60 to about 50% supplemental oxidizing salt.

13. An apparatus for inflating a vehicle occupant protection device, said apparatus comprising:

means defining a combustion chamber;

a mass of gas generating material within said combustion chamber for, when ignited, generating gas for inflating the occupant protection device; and an ignitor for igniting said gas generating material;

said gas generating material comprising a complex of a cyanamide compound and a transition metal nitrate, and a supplemental oxidizing salt admixed with said complex.

14. The apparatus of claim 13 wherein said cyanamide compound is dicyandiamide.

15. The apparatus of claim 14 wherein said transition metal nitrate is copper nitrate.

16. The apparatus of claim 15 wherein said complex is bis(dicyandiamide)copper(I)nitrate.

17. An apparatus for inflating a vehicle occupant protection device, said apparatus comprising:

means defining a combustion chamber;

a mass of gas generating material within said combustion chamber for, when ignited, generating gas for inflating the occupant protection device; and an ignitor for igniting said gas generating material;

said gas generating material comprising a ligand and an oxidizing salt wherein said ligand is a cyanamide and at least a part of said oxidizing salt is a transition metal nitrate complexed with said cyanamide.

18. The apparatus of claim 17 wherein said cyanamide is dicyandiamide.

19. The apparatus of claim 18 wherein said transition metal nitrate is copper nitrate.

20. The apparatus of claim 19 wherein said complex is bis(dicyandiamide)copper(I)nitrate.

* * * * *